US007752794B2

(12) United States Patent
Kerlin

(10) Patent No.: US 7,752,794 B2
(45) Date of Patent: Jul. 13, 2010

(54) IDENTIFICATION WRISTBAND

(75) Inventor: Jeffrey Kerlin, Brookfield, WI (US)

(73) Assignee: Precision Dynamics Corporation, San Fernando, CA (US)

( * ) Notice: Subject to any disclaimer, the term of this patent is extended or adjusted under 35 U.S.C. 154(b) by 200 days.

(21) Appl. No.: 12/207,203

(22) Filed: Sep. 9, 2008

(65) Prior Publication Data

US 2010/0058636 A1 Mar. 11, 2010

(51) Int. Cl.
*A44C 5/00* (2006.01)

(52) U.S. Cl. ..... 40/633; 428/41.9

(58) Field of Classification Search ..... 40/633
See application file for complete search history.

(56) References Cited

U.S. PATENT DOCUMENTS

| | | | | |
|---|---|---|---|---|
| 3,153,869 | A | 10/1964 | Twentier | |
| 3,197,899 | A | 8/1965 | Twentier | |
| 3,279,107 | A | 10/1966 | Baumgartner | |
| 4,420,519 | A | 12/1983 | Slemmons | |
| 4,624,875 | A | 11/1986 | Watanabe et al. | |
| 4,682,431 | A | 7/1987 | Kowalchuk | |
| 4,914,843 | A | 4/1990 | DeWoskin | |
| 4,991,337 | A | 2/1991 | Solon | |
| 5,457,906 | A | 10/1995 | Mosher, Jr. | |
| 5,799,426 | A | 9/1998 | Peterson | |
| 6,100,804 | A | 8/2000 | Brady et al. | |
| 6,349,493 | B1 * | 2/2002 | Newman et al. | 40/633 |
| 6,782,648 | B1 * | 8/2004 | Mosher, Jr. | 40/633 |
| 6,783,830 | B2 * | 8/2004 | Cohen et al. | 428/40.1 |
| 6,836,215 | B1 | 12/2004 | Laurash et al. | |
| 2004/0164544 | A1 | 8/2004 | Thall et al. | |
| 2007/0028495 | A1 * | 2/2007 | Kotik et al. | 40/633 |

OTHER PUBLICATIONS

"Custom Tyvek Wristbands," Admit One Products, http://web.archive.org/web/20070829152430/http://www.admitoneproducts.com/Wristbands/Tyvek+Wristbands/Custom+Tyvek+Wristbands/, Aug. 29, 2007.*

* cited by examiner

*Primary Examiner*—Gary C Hoge
(74) *Attorney, Agent, or Firm*—Kelly Lowry & Kelley, LLP

(57) ABSTRACT

An identification wristband includes a liner layer permanently affixed to one end thereof, which covers an adhesive whereby the wristband may be secured to a person or object in a looped fashion securing the ends of the wristband together. The liner releasably covers a portion of the adhesive and is permanently attached to an adjacent portion of the adhesive. In this way, the liner is not separable from the wristband. The liner includes a first portion which is not adhered to the wristband to allow for ease of separation. The liner layer also includes a second portion that is not adhered to the wristband to ensure against accidentally exposed adhesive.

14 Claims, 2 Drawing Sheets

IDENTIFICATION WRISTBAND

BACKGROUND OF THE INVENTION

This invention relates to closures for identification bands, and specifically to an improved adhesive closure.

The use of identification bracelets is substantial, both in traditional areas such as hospital patient admissions and in other applications such as crowd control and patron identification. In many such applications, adhesive closure bracelets may be effectively utilized. Such bands typically include an elongated bracelet or strap with an adhesive portion near one end. A disposable, throw-away shield covers the adhesive until just prior to use, at which time the shield is removed from the adhesive and discarded, permitting the ends of the bracelet to be joined to each other.

As indicated, in conventional adhesive closures for identification bands, the shield is separate from the band. Upon the required removal of the shield to expose the adhesive, the shield becomes waste which must be disposed of in some way. Among other things, appropriate disposal (especially in view of the large volumes of bracelets which are frequently used) necessarily requires an increase in the labor associated with use of the bracelet. Additionally, if the shields are not properly disposed of, the separation of the shields from the bands at the point of application can pollute the environment, especially in outdoor applications.

The adhesive closure for identification band described in U.S. Pat. No. 5,457,906 describes an identification band having a shield means for covering an adhesive layer until the identification band is used. A first portion of the shield means includes a release layer such that it is releasably attached to the adhesive. An adjacent second portion of the shield means does not include a release layer such that the second portion is permanently attached to the adhesive layer. In this way, the shield means remains attached to the wristband rather than being separable to create waste requiring disposal.

One drawback of such prior art devices is that the shield layer may be adhered to the wristband around its entire perimeter, thus making it difficult to easily and quickly separate the first portion of the shield means from the band. Another disadvantage in the prior art device exists insofar as the shield means may not completely cover the adhesive layer. If a portion of the adhesive layer is exposed along an edge of the shield means, such exposed adhesive may come into contact with the person or object to which the wristband is secured. Such contact with the adhesive may create discomfort for a person or a hindrance to proper use of the wristband on an object.

It is, therefore, an object of the present invention to provide an improved adhesive closure for identification bracelets. The improved adhesive closure should include a means for increasing the ease and speed with which the first portion of the shield is released from the band. In addition, the improved adhesive closure should prevent accidental contact between the adhesive and the person or object to be identified around the edge of the shield. As with the prior art devices, even when a portion of the shield is moved or folded out of the way to expose the adhesive, the shield remains attached to the wristband, thus not requiring disposal.

The present invention fulfills these needs and provides other related advantages.

SUMMARY OF THE INVENTION

The present invention is directed to an identification wristband having an elongated body for encircling a person or an object to be identified. The wristband comprises a media layer having a first end, a second end and an information receiving area therebetween. A securement area on an underside of the media layer is positioned adjacent to the first end. The securement area includes a first unbonded zone immediately adjacent to the first end, a release zone adjacent to the first unbonded zone, and a fixed zone adjacent to the release zone. An adhesive layer is substantially coextensive with the release zone and the fixed zone. A liner layer substantially coextensive with the securement area is permanently adhered to the media layer in the fixed zone. A release layer positioned between the liner layer and the release zone releasably adheres the liner layer to the media layer in the release zone.

A plurality of identification wristbands may be provided. The plurality of identification wristbands may result from dividing the media layer by including a plurality of parallel cuts extending between the first and second ends thereof. Such plurality of wristbands may be included on a media sheet. In an alternate embodiment, the plurality of identification wristbands may be provided in a roll form wherein the identification wristbands are attached end-to-end.

The first unbonded zone is preferably devoid of adhesive such that the liner layer is not adhered to the media layer in the first unbonded zone. The securement area may further comprise a second unbonded zone adjacent to the fixed zone. This second unbonded zone is preferably devoid of adhesive such that the liner layer is not adhered to the media layer in the second unbonded zone.

The liner layer is preferably foldable when released from the release zone. When so released and folded, the liner layer exposes the adhesive layer for securement of the second end of the media layer to the first end of the media layer. The liner layer is foldable along an edge of the fixed zone. The identification wristband further comprises a score pattern on the media layer substantially within the release zone.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
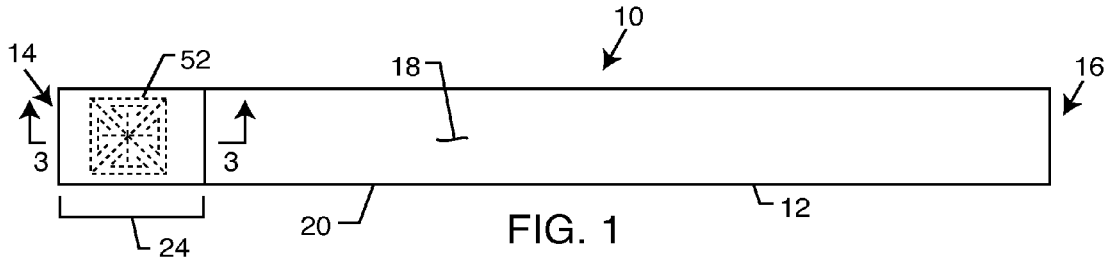
FIG. 1 is a top view of a preferred embodiment of an identification wristband in accordance with the teachings of the invention.
Figure 2:
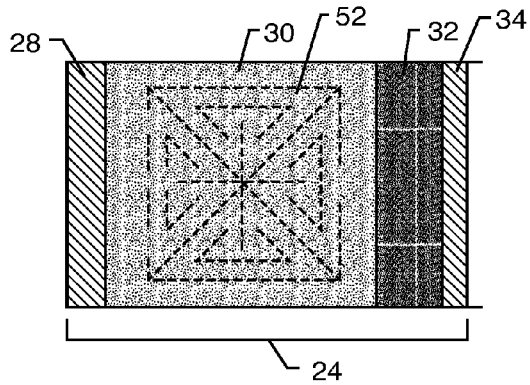
FIG. 2 is a bottom view of the first end of a preferred embodiment of an identification wristband in accordance with the teachings of the invention.
Figure 3:
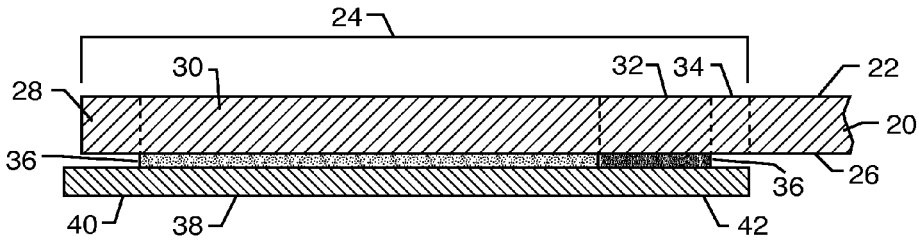
FIG. 3 is a cross-sectional view taken along line 3-3 of FIG. 1.

Referring to the drawings, FIGS. 1-3, an identification wristband generally referred to by reference numeral 10 is shown. The wristband 10 comprises an elongated body 12 fabricated from plastic or paper or other suitable material for an identification band. The body 12 includes a first end 14, a second end 16 and an information receiving area 18 disposed between the first and second ends. The information receiving area 18 is adapted to receive identifying information relating to an object or person.

The elongated body 12 comprises mainly a media layer 20. This media layer 20 is preferably fabricated from the plastic or paper or other suitable material described above. The information receiving area 18 is preferably positioned on an upper side 22 of the media layer 20. The first end 14 includes a securement area 24. The securement area 24 is preferably positioned on the underside 26 of the media layer 20. However, a person skilled in the art will realize that the information receiving area 18 and the securement area 24 may both be on the same side of the media layer 20 and the invention can still function as intended.

In a preferred embodiment, the securement area 24 includes a first unbonded zone 28, a release zone 30, a fixed zone 32 and a second unbonded zone 34, arranged in the listed order from the first end 14. The first unbonded zone 28 is preferably positioned immediately adjacent to the first end 14. The release zone 30 is positioned adjacent to the first unbonded zone 28 such that it is spaced apart from the first end 14 at least as far as the width of the first unbonded zone 28. The fixed zone is positioned adjacent to the release zone 30 on the opposite side of the release zone 30 from the first unbonded zone 28. The second unbonded zone 34 is positioned adjacent to the fixed zone 32 on the side of the fixed zone 32 opposite from the release zone 30. The function of these zones will be described further below.

An adhesive layer 36 is positioned in the securement area 24 substantially coextensive with the release zone 30 and fixed zone 32. A liner layer 38 substantially coextensive with the securement area 24 is positioned over the adhesive layer 36. The liner layer 38, the adhesive layer 36, and the zones 28, 30, 32 and 34 are configured such that the liner layer 38 is adhered to the securement area 24 in the release zone 30 and fixed zone 32.

A first portion 40 of the liner layer extends beyond an edge of the release zone 30 such that it overlaps the first unbonded zone 28. This first portion 40 of the liner layer 38 is thus not adhered to the media layer 20 in the area corresponding to the first unbonded zone 28. Further, a second portion 42 of the liner layer 38 extends beyond an edge of the fixed zone 32. This second portion 42 overlaps the second unbonded zone 34 which is devoid of adhesive. In this way the second portion 42 is not adhered to the media layer 20 in the area corresponding to the second unbonded zone 34.

The fact that the first portion 40 is not adhered to the media layer 20 allows for ease of separation of the liner layer 38 from the media layer 20. If the liner layer 38 was completely adhered to the media layer 20 along the edge adjacent to the first end 14, then a user may find difficulty in separating the liner layer 38 from the media layer 20. The first portion 40 being free of adhesive and unbonded to the media layer 20 provides a flap whereby a user may more easily grasp the liner layer 30 when attempting to separate the same from the media layer 20.

The second portion 42 provides protection against accidental exposure of the adhesive layer 36 on the underside 26 of the media layer 20. If the adhesive layer 36 were to extend into the second unbonded zone 34, the possibility of adhesive being exposed around the edge of the liner layer 38 in the second unbonded zone 34 increases. By including the second unbonded zone 34 and creating the second portion 42 which is unbonded to the media layer 20, the possibility that a portion of the adhesive layer 36 is exposed around the edge of the liner layer 38 is significantly decreased. If adhesive were exposed around the edge of the liner layer 38, such adhesive might adhere to the surface of an object or the skin of a person to which the wristband is attached. Such adherence to the object or person may interfere with the proper use of the wristband or the comfort of a person wearing such wristband.

Figure 4:
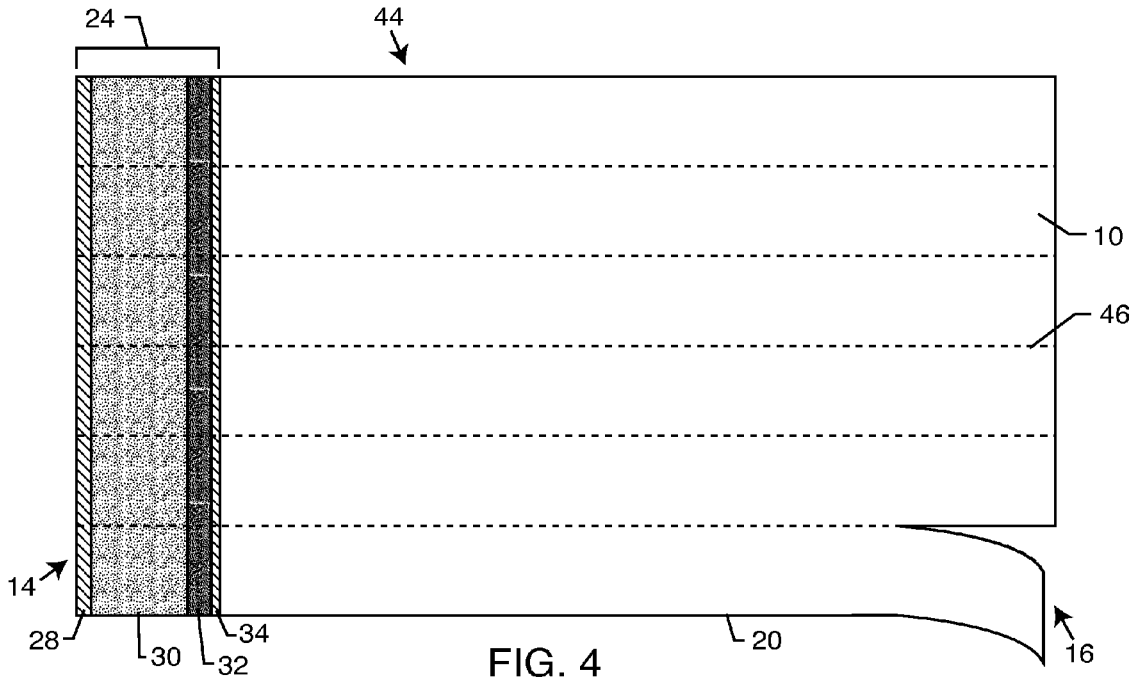
FIG. 4 is a bottom view of a preferred embodiment of a sheet of identification wristbands in accordance with the teachings of the invention.

As depicted in FIG. 4, the inventive wristband 10 may be presented in a sheet 44 of such wristbands 10 wherein each wristband is separated from an adjacent wristband by a plurality of parallel cuts 46 extending from the first end 14 to the second end 16. In this way a plurality of wristbands 10 may be presented in a single sheet 44. Individual wristbands 10 may be separated from the sheet 44 by tearing along the parallel cut 46.

Figure 5:
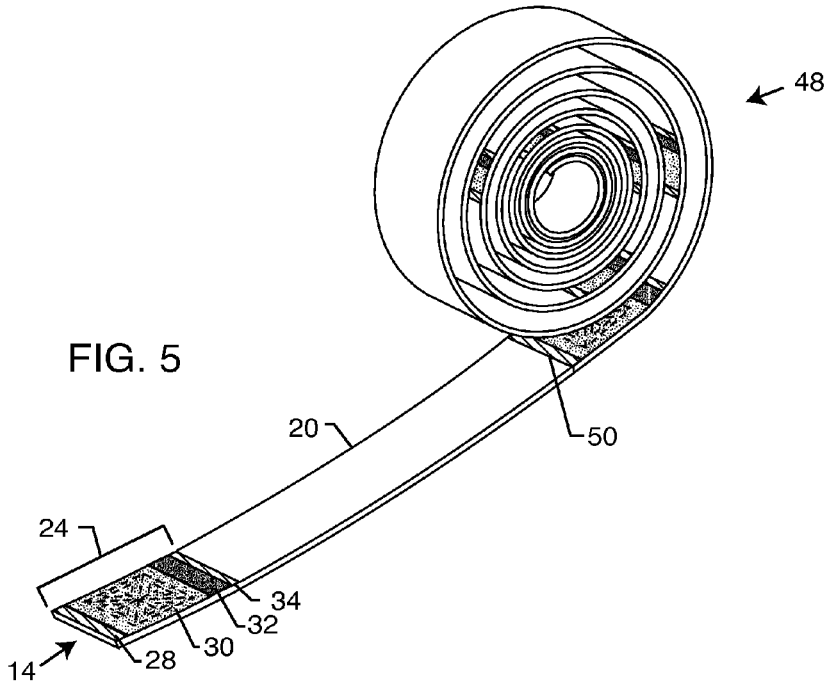
FIG. 5 is a perspective view of a preferred embodiment of a roll of identification wristbands in accordance with the teachings of the invention.

In an alternate embodiment, as shown in FIG. 5, the inventive wristbands 10 may be presented in a roll form 48 wherein individual wristbands 10 are arranged end-to-end and separated by a series of transverse cuts 50. In this way, a wristband 10 may be unraveled from the roll 48 and separated from the adjacent wristband by tearing along the transverse cut 50.

The wristband 10 preferably includes a score pattern 52 that substantially coincides with the release zone 30. The score pattern 52 passes through the media layer 20 and provides points of weakness to indicate whether a wristband 10 has been tampered with after securement. If a person attempts to remove the first end 14 from the second end 16 after they have been adhered to one another, the points of weakness in the score pattern 52 will cause the media layer to tear and separate, thus indicating the attempted removal of the wristband 10.

Although several embodiments have been described in detail for purposes of illustration, various modifications may be made without departing from the scope and spirit of the invention. Accordingly, the invention is not to be limited, except as by the appended claims.

What is claimed is:

1. An identification wristband having an elongated body for encircling a person or an object to be identified, comprising:

a media layer having a first end, a second end and an information receiving area therebetween;

a securement area on an underside of the media layer adjacent to the first end thereof, the securement area including a first unbonded zone immediately adjacent to the first end, a release zone adjacent to the first unbonded zone, and a fixed zone adjacent to the release zone;

an adhesive layer on the media layer substantially co-extensive with the release zone and the fixed zone;

a liner layer positioned over and substantially co-extensive with the securement area such that the liner layer overlaps a portion of the first unbonded zone, the liner layer relatively permanently adhered to the media layer in the fixed zone and including a release layer between the liner layer and the release zone releasably adhering the liner layer to the media layer in the release zone; and a second unbonded zone adjacent to the fixed zone, wherein the liner layer overlaps a portion of the second unbonded zone and the second unbonded zone is devoid of adhesive such that the liner layer is not adhered to the media layer in the second unbonded zone.

2. The identification wristband of claim 1, wherein the media layer includes a plurality of parallel cuts extending between the first and second ends for dividing the media layer into a plurality of identification wristbands.

3. The identification wristband of claim 1, further comprising a plurality of identification wristbands attached end-to-end and formed in a roll.

4. The identification wristband of claim 1, wherein the first unbonded zone is devoid of adhesive such that the liner layer is not adhered to the media layer in the first unbonded zone.

5. The identification wristband of claim 1, further comprising a score pattern on the media layer substantially within the release zone.

6. The identification wristband of claim 1, wherein said liner layer is foldable when released from the release zone to expose said adhesive layer for securement of said second end to said first end, the liner layer being folded along an edge of the fixed zone.

7. An identification wristband having an elongated body for encircling a person or an object to be identified, comprising:

a media layer having a first end, a second end and an information receiving area therebetween;

a securement area on an underside of the media layer adjacent to the first end thereof, the securement area including a first unbonded zone immediately adjacent to the first end, a release zone adjacent to the first unbonded zone, a fixed zone adjacent to the release zone and a second unbonded zone adjacent to the fixed zone;

an adhesive layer on the media layer substantially co-extensive with the release zone and the fixed zone, the first and second unbonded zones being devoid of adhesive; and a liner layer positioned over and substantially co-extensive with the securement area such that the liner layer overlaps a portion of both the first and second unbonded zones, the liner layer relatively permanently adhered to the media layer in the fixed zone, not adhered to the first and second unbonded zones, and including a release layer between the liner layer and the release zone releasably adhering the liner layer to the media layer in the release zone.

8. The identification wristband of claim 7, wherein the media layer includes a plurality of parallel cuts extending between the first and second ends for dividing the media layer into a plurality of wristbands.

9. The identification wristband of claim 7, further comprising a plurality of identification wristbands attached end-to-end and formed in a roll.

10. The identification wristband of claim 7, further comprising a score pattern on the media layer substantially within the release zone.

11. The identification wristband of claim 7, wherein said liner layer is foldable when released from the release zone to expose said adhesive layer for securement of said second end to said first end, the liner layer being folded along an edge of the fixed zone.

12. A media sheet comprising a plurality of identification wristbands, each having an elongated body for encircling a person or an object to be identified, comprising:

a media layer having a first end, a second end, an information receiving area therebetween and a plurality of parallel cuts extending between the first and second ends for dividing the media layer into said plurality of wristbands;

a securement area on an underside of the media layer adjacent to the first end thereof, the securement area including a first unbonded zone immediately adjacent to the first end, a release zone adjacent to the first unbonded zone, and a fixed zone adjacent to the release zone;

an adhesive layer on the media layer substantially co-extensive with the release zone and the fixed zone;

a liner layer positioned over and substantially co-extensive with the securement area such that the liner layer overlaps a portion of the first unbonded zone, the liner layer relatively permanently adhered to the media layer in the fixed zone and including a release layer between the liner layer and the release zone releasably adhering the liner layer to the media layer in the release zone; and a second unbonded zone adjacent to the fixed zone, wherein the liner layer overlaps a portion of the second unbonded zone and the second unbonded zone is devoid of adhesive such that the liner layer is not adhered to the media layer in the second unbonded zone.

13. The media sheet of claim 12, wherein the first unbonded zone is devoid of adhesive such that the liner layer is not adhered to the media layer in the first unbonded zone.

14. The media sheet of claim 12, wherein said liner layer is foldable when released from the release zone to expose said adhesive layer for securement of said second end to said first end, the liner layer being folded along an edge of the fixed zone.

* * * * *